US009295353B2

(12) United States Patent
Joosten

(10) Patent No.: US 9,295,353 B2
(45) Date of Patent: Mar. 29, 2016

(54) AID FOR PULLING ELASTIC STOCKINGS ON AND OFF

(75) Inventor: Erik Theodorus Johannus Joosten, Geleen (NL)

(73) Assignee: ARION HOLDING B.V., Geleen (NL)

( * ) Notice: Subject to any disclaimer, the term of this patent is extended or adjusted under 35 U.S.C. 154(b) by 386 days.

(21) Appl. No.: 12/765,443

(22) Filed: Apr. 22, 2010

(65) Prior Publication Data

US 2010/0270341 A1 Oct. 28, 2010

(30) Foreign Application Priority Data

Apr. 23, 2009 (NL) ..... 2002780

(51) Int. Cl.
*A47G 25/90* (2006.01)

(52) U.S. Cl.
CPC ..... *A47G 25/907* (2013.01)

(58) Field of Classification Search
CPC . A47G 25/905; A47G 25/907; A47G 25/908; D06C 5/005
USPC ..... 223/111–113
See application file for complete search history.

(56) References Cited

U.S. PATENT DOCUMENTS 397,752 A * 2/1889 Ready ..... 223/111
2,065,936 A * 12/1936 Hardie ..... 2/240
3,315,276 A * 4/1967 Daxe ..... A41B 11/00 2/239
3,401,856 A * 9/1968 Berlin ..... 223/111
3,574,958 A * 4/1971 Martuch ..... 36/116
3,868,729 A * 3/1975 Lynam ..... 2/237
4,066,194 A * 1/1978 Leland ..... 223/111
4,153,054 A * 5/1979 Boone ..... 128/856
4,204,345 A * 5/1980 Bradley ..... 36/97
4,229,833 A * 10/1980 Cox et al. ..... 2/16
4,284,216 A * 8/1981 Leland ..... 223/111
4,482,084 A * 11/1984 Beskin ..... 223/111
4,516,704 A * 5/1985 Hagman ..... 223/111
4,538,368 A * 9/1985 Mugford ..... 36/112
4,637,532 A * 1/1987 Doorenbos ..... 223/111
4,637,533 A * 1/1987 Black ..... 223/112
4,651,909 A * 3/1987 Banting ..... 223/111
4,708,272 A * 11/1987 Guerra ..... 223/113
4,809,447 A * 3/1989 Pacanowsky ..... A41B 11/005 2/239
5,356,057 A * 10/1994 Vossen ..... 223/112
5,542,121 A * 8/1996 Lahaussois et al. ..... 2/59
5,601,220 A * 2/1997 Vossen ..... 223/112
5,673,826 A * 10/1997 Stolk ..... 223/112
5,924,609 A * 7/1999 Stolk et al. ..... 223/112

(Continued)

FOREIGN PATENT DOCUMENTS

NL 8902619 A 5/1991

*Primary Examiner* — Shaun R Hurley
*Assistant Examiner* — Andrew W Sutton
(74) *Attorney, Agent, or Firm* — The Webb Law Firm

(57) ABSTRACT

The invention relates to an aid for pulling elastic stockings on and off. The aid comprises a flexible, tube-like peripheral body of a smooth material with an insertion end for a foot. The peripheral body is provided with a lining of a smooth material which is attached to the peripheral body at the position of the insertion end and can otherwise be moved freely relative to the peripheral body from an inward folded position, in which the lining is situated in the peripheral body, to an outward folded position in which the lining is situated outside the peripheral body. The peripheral body further comprises tensioning means with which the aid can be secured at least temporarily round a leg. This makes the aid suitable for both pulling on and pulling off elastic stockings.

18 Claims, 5 Drawing Sheets

(56) References Cited

U.S. PATENT DOCUMENTS

| | | | | |
|---|---|---|---|---|
| 6,032,839 | A * | 3/2000 | Joosten et al. | 223/112 |
| 6,523,729 | B1 * | 2/2003 | Gardon-Mollard | 223/112 |
| 7,699,195 | B2 * | 4/2010 | Scott | 223/111 |
| 8,042,716 | B2 * | 10/2011 | Lun | 223/111 |
| 2007/0119882 | A1 * | 5/2007 | Scott | 223/111 |
| 2009/0242594 | A1 * | 10/2009 | Van Den Berge et al. | 223/111 |
| 2010/0089954 | A1 * | 4/2010 | Rondeau et al. | 223/111 |

* cited by examiner

AID FOR PULLING ELASTIC STOCKINGS ON AND OFF

BACKGROUND OF THE INVENTION

1) Field of the Invention

The invention relates to an aid for pulling on and off elastic stockings, in particular therapeutic elastic stockings.

2) Discussion of the Prior Art

A therapeutic elastic stocking or support stocking is frequently applied as medical aid for users with varicose veins and other vascular problems. For a good therapeutic effect the support stocking must exert a great tensioning force on the leg. Owing to the desired great tensioning force the user encounters problems when pulling on and pulling off the elastic stocking.

An aid for pulling on elastic stockings is known from NL 8902619. The known aid comprises a flexible tube-like peripheral body of a smooth material with an insertion end for a foot, the peripheral body being provided with a lining of a smooth material. The lining is attached to the peripheral body at the position of the insertion end and can otherwise be moved freely relative to the peripheral body from an inward folded position, in which the lining is situated in the peripheral body, to an outward folded position in which the lining is situated outside the peripheral body.

When pulling on a therapeutic stocking the user places his/her foot via the insertion end into the aid, with the lining in inward folded position, until the toe reaches the outer end of the lining and the peripheral body covers a part of the leg. An elastic stocking with open toe part is then slid over the aid arranged round the leg, wherein only a small force need be exerted because of the easy sliding of the elastic stocking over the smooth material of the peripheral body. When the aid is removed, after the therapeutic elastic stocking has been pulled on, by pulling the peripheral body or a pulling member fastened thereto at the position of the toe part, the lining is as it were peeled off over itself until it reaches the outward folded position and the aid is fully pulled away from under the elastic stocking. Hardly any frictional contact occurs here between the leg and the aid.

A drawback of the known aid is that it cannot be used to once again remove an elastic stocking present on the leg. An elastic stocking must however be removed daily and, because the stocking fits so tightly onto the leg, pulling off the stocking also requires great force, among other reasons because the stocking has to be pulled off the leg and along the heel of the foot, thereby encountering high friction. Also a frequent occurrence is that the stockings are damaged as they are pulled off because for instance they hook behind a fingernail.

The invention has for its object to provide an aid for the purpose of pulling on elastic stockings, which aid can also serve to remove elastic stockings from the leg with little exertion of force.

SUMMARY OF THE INVENTION

According to the invention the aid for pulling elastic stockings on and off comprises a flexible, tube-like peripheral body of a smooth material with an insertion end for a foot, which peripheral body is provided with a lining of a smooth material, which lining is attached to the peripheral body at the position of the insertion end and can otherwise be moved freely relative to the peripheral body from an inward folded position, in which the lining is situated in the peripheral body, to an outward folded position in which the lining is situated outside the peripheral body, wherein the peripheral body also comprises tensioning means with which the aid can be secured at least temporarily round a leg. Providing the known pull-on aid with tensioning and other means achieves that pulling off an elastic stocking can take place with negligible exertion of force. In order to pull off an elastic stocking the user places his/her foot via the insertion end into the aid, with the lining in inward folded position, until the toe reaches the outer end of the lining and the peripheral body covers a part of the leg. Using the available tensioning means the aid is then secured round the leg, the lower leg or the ankle. The upper edge of the elastic stocking is subsequently grasped and folded back a small distance in the direction of the foot so that the folded part of the peripheral surface of the aid makes contact with a non-folded part of the same peripheral surface. By now further unrolling the elastic stocking by hand in the direction of the foot, the parts of the peripheral surface of the aid will slide over each other. Although both parts of the peripheral surface are held against each other under the pressure of the elastic stocking, the sliding can take place practically without friction, among other reasons due to the properties of the material from which the aid is made. The part of the elastic stocking that is in contact with the leg, which contact could in principle cause quite a high friction force, remains substantially stationary. The tensioning means ensure among other things that the aid and the elastic stocking do not slide prematurely from the foot during unrolling of the elastic stocking. During further combined unrolling of stocking and aid in the direction of the foot, the tensioning means will at a given moment be reached. In order to enable complete unrolling of the elastic stocking, the tensioning means are released if desired. This can be done for instance by hand. Preferably however, the tensioning means do not require active release. Once the elastic stocking has thus been removed from the leg, the aid is in inside-out position in the pulled-off elastic stocking. The aid can be removed easily therefrom and restored to its original form by once again returning the lining to the inward folded position. In this situation the aid is once again ready for the purpose of pulling on an elastic stocking (for instance the following morning).

The aid according to the invention provides the user with only one aid which can serve for both pulling on and pulling off elastic stockings. The user does not therefore need to use two individual aids which possibly resemble each other, which can cause confusion.

A further advantage of the aid according to the invention is that the tensioning means provide advantages not only when an elastic stocking is pulled off but also when it is pulled on. The tensioning means do indeed ensure that the aid arranged on a leg remains in position round the foot when the elastic stocking is slid over the aid. The known aid tends to slide off the foot before the elastic stocking is arranged.

A preferred embodiment of the aid according to the invention is characterized in that the tensioning means are received in a sheath of smooth material and can move therein. Because the tensioning means are substantially enclosed by smooth material in this embodiment, and are preferably manufactured from the same smooth material as that of the peripheral body and/or the lining, no inconvenience is caused by the tensioning means when the aid is pulled on. Because the outer surface of the aid is substantially smooth, an elastic stocking will be able to slide easily over the aid. Nor do the tensioning means cause any inconvenience when the aid is pulled off.

It is advantageous that the sheath for the tensioning means forms an integral part of the peripheral body. Such a sheath can for instance be obtained by folding the peripheral body back onto itself at the position where the tensioning means must be arranged, and to attach to each other the edges that have been brought together, for instance by stitching. It will be apparent that different techniques of clothing manufacture can be applied for this purpose.

A further preferred embodiment of the aid according to the invention has the feature that the sheath is provided on the inner side thereof—this being the side facing toward the tensioning means—with a rough surface which transmits a friction force to the tensioning means. Such a rough surface can for instance be obtained by providing the sheath on the inner side thereof with a cloth with a coarse textile structure and/or with a cloth with a rough cover layer. Such a cover layer can for instance comprise a rubber, more preferably a silicone rubber.

Further advantages are gained when the aid according to the invention comprises a sheath which varies in width. Additional space between the sheath and the tensioning means received therein is hereby created at the position of the wider parts of the sheath. This also provides more space at that position for the surrounding smooth material of the peripheral body, whereby this material can be drawn together to greater extent during tightening of the tensioning means. This provides for a better fixation of the aid around a foot, leg or ankle provided with an elastic stocking when it is being pulled off.

A preferred embodiment of the aid according to the invention is characterized in that the tensioning means comprise an elastic band (or a plurality of elastic bands) with a smaller circumference than that of the peripheral body. When the aid is pulled on, the elastic band is preferably arranged in peripheral direction round the leg. Once the aid has been arranged at the desired height round the leg, the band will, because of the smaller circumference, automatically tension round the leg with a certain tensioning force and secure the aid on the leg. The present embodiment has the advantage that the user need not perform any separate operation, other than sliding the aid over the leg, in order to secure the aid on the leg. In the context of the present invention band is understood to mean an elongate body with a length substantially larger than the transverse dimensions, for instance a minimum of five times larger. A band can for instance also comprise a thread, a strand, a narrow woven fabric, a knit or a yarn or a combination thereof, without otherwise being limited thereto. It is also possible to stitch the elastic band or bands with or without sheath onto the peripheral body, preferably in crosswise direction or in peripheral direction. The elastic band is preferably arranged at the position of the insertion end of the peripheral body, for instance several centimeters removed from the insertion side in the direction of the toe part.

The circumference of the elastic band relative to the circumference of the peripheral body or the circumference of the sheath can be selected within wide limits, and is preferably smaller than the circumference of the peripheral body or sheath. A particularly suitable circumference amounts to about half the circumference of the peripheral body or sheath. The elastic band and/or thread is preferably sufficiently stretchable to be able to develop a sufficient tensioning force. The stretch is preferably at least 50%, more preferably at least 80% and most preferably at least 100%. The stiffness of the elastic band can likewise be selected within wide limits, for instance subject to the wishes and possibilities of the user.

The tensioning means ensure that the aid is held relatively tightly against the leg, in any case at the position of the tensioning means, preferably the elastic band. At other positions along the leg the aid can be present more loosely round the leg. The desired height of arrangement of the aid is in principle free. Preferably however, the aid is arranged up to a height reaching just above the ankle. Because the elastic stocking does not therefore make contact with the leg on the top side of the aid, it can be readily grasped and only folded back over a small height. The desired height of arrangement of the tensioning means is likewise free in principle. The tensioning means are preferably arranged at a position of the peripheral body such that with proper use they are situated at the position of the lower leg, and more preferably just above the ankle.

A particularly advantageous embodiment of the aid according to the invention is provided with tensioning means, preferably in the form of an elastic band, which can be tightened by means of pull loops accessible to the user. Such an embodiment can for instance be obtained by receiving the elastic band or bands in a sheath, and providing the sheath at at least one, but preferably at least two, positions with an opening through which can be inserted a pull loop connected to the elastic band(s) or integrated therewith. Such an embodiment makes arranging of the aid simpler. The tensioning force can moreover be adjusted by the user him/herself depending for instance on the thickness of the leg, foot or ankle. In the use of the aid as means for pulling on elastic stockings the presence of the pull loop or pull loops is surprisingly found to hardly impede the operation of the aid.

A further advantage of the aid according to the invention is that, during combined unrolling of stocking and aid along the leg, the tensioning means do not have to be separately loosened by the user so as not to impede further unrolling. Furthermore, due to the specific construction of the aid no danger at all will occur, for instance because the elastic band comes loose, when the aid is being pulled on or off.

Further advantages are gained by characterizing the aid according to the invention in that the aid also comprises fixing means for the purpose of providing further resistance to springing back of the tensioning means in the tensioned state. More preferably still, the fixing means comprise pieces of fabric material which are received in the sheath and which run slightly transversely of the tensioning means in the form of for instance elastic band(s), and are provided with an opening through which the tensioning means pass. In an embodiment in which the sheath has openings, for instance for pull loops, the fixing means are preferably arranged in the sheath at the position of the openings. They then also serve to strengthen the openings. It is otherwise also possible to strengthen the openings by providing for instance the peripheral edge thereof with stitching.

The aid can in principle be manufactured in any suitable manner. According to a preferred variant, the aid is characterized in that the peripheral body is formed by bringing together and at least partially connecting to each other two opposite free edge portions of a flat sheet of the material, thereby forming a shared edge portion. This makes arranging of the aid easier and moreover results in improved functionality thereof. How the fixation is performed does not matter here. It is thus possible to connect both free edge portions by means of a 'permanent' connection, such as for instance a stitch connection and/or an adhesive connection. Another option consists of connecting the two sheets to each other by means of a releasable connection, such as for instance with Velcro tape. If desired, both edge portions can then be connected to each other only when in use.

The shared edge portions preferably extend in longitudinal direction of the aid. It is further advantageous if the connection is a stitched connection, which is formed by a felled seam. A further reduced friction between aid and contact surface can be achieved by arranging the connection in the form of a felled seam. It has moreover been found that the use of a felled seam prolongs the lifespan of the aid without this having adverse effects on the operation thereof.

The aid according to the invention can in principle be manufactured from any material, as long as it is sufficiently flexible and smooth. In a preferred embodiment, the aid is characterized in that the smooth material comprises a material structure coated with a low-friction plastic. The low-friction plastic preferably comprises a polyolefin, such as for instance polyethylene, polypropylene and co-polymers thereof. The low-friction plastic most preferably comprises a polytetrafluoroethylene.

Suitable material structures comprise any fabric, non-woven, knit, stitch, film, perforated film, unidirectional fabric and so on known to the skilled person, provided the textile structure is preferably relatively thin. Within the scope of the present application this is understood to mean that the weight per unit area of the textile structure is relatively limited. Suitable weights per unit area range between 10 and 200 $g/m^2$, preferably between 25 and 100 $g/m^2$, and more preferably between 30 and 60 $g/m^2$. A particularly suitable glass fibre cloth with a polytetrafluoroethylene coating is commercially available from Eriks B.V. under the product name Chemglas PTFE glass fabric 100-3.

The material from which the textile structure is manufactured can also be selected within wide limits. Suitable materials comprise glass fibres, carbon fibres, organic fibres such as for instance polyaramid fibres, polyethylene fibres, polyamide fibres, polyester fibres and so on. A particularly suitable aid comprises a textile structure manufactured from a plastic selected from the group of polyesters and/or polyamides. The frictional resistance of the materials moving against each other during the "unrolling" can further be reduced by using a thermoplastic plastic and/or low-friction plastic to which an anti-block agent such as for instance hydrotalcite has been added. The above stated materials have a very low coefficient of friction, are generally highly anti-adhesive and moreover weather and sunlight-resistant. The materials are further sufficiently strong to withstand, with negligible elongation, the tensile stresses occurring when elastic stockings are pulled off.

It is further noted that the aid can advantageously be applied when putting on an elastic stocking with open toe piece. The aid can also be advantageously applied for the purpose of pulling off an elastic stocking with open toe piece, as well as for pulling off an elastic stocking with closed toe piece.

BRIEF DESCRIPTION OF THE DRAWINGS

The invention will now be further elucidated on the basis of the exemplary embodiments shown in the figures, without however being limited thereto.

Herein.

DETAILED DESCRIPTION OF THE PREFERRED EMBODIMENTS

Figure 1:
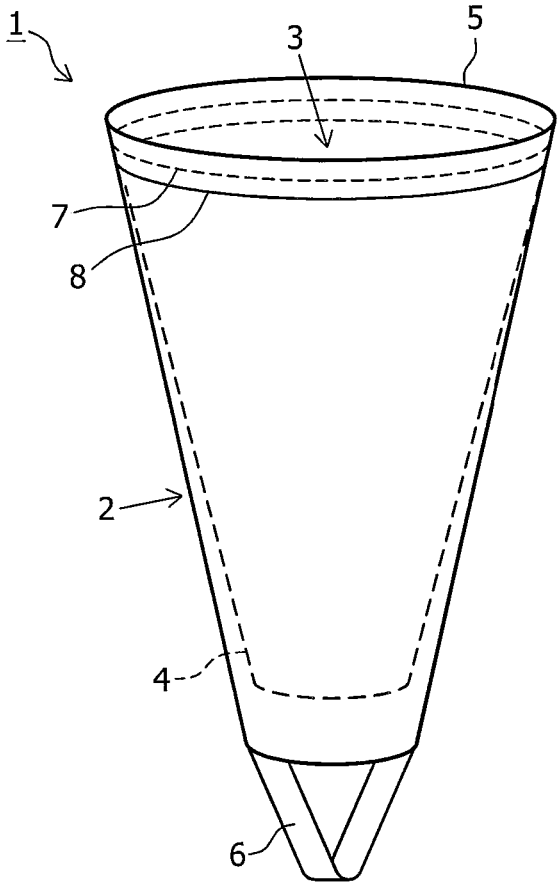
FIG. 1 is a schematic perspective side view of a first embodiment of the aid according to the invention.
Figure 2A:
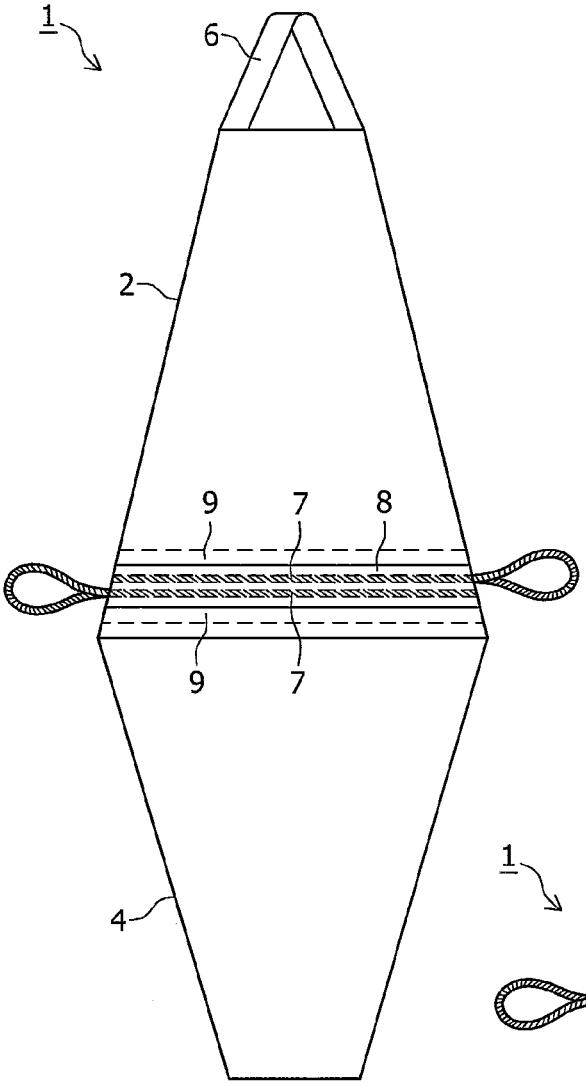
FIG. 2A is a schematic side view of a second embodiment of the aid according to the invention with the lining in the outward folded position.

Referring to FIG. 1, an aid 1 is shown for pulling elastic stockings 10 on and off. Aid 1 comprises a flexible tube-like peripheral body 2 of a smooth material, such as for instance glass fibre cloth with a polytetrafluoroethylene coating, with an insertion end 3 for a foot. Peripheral body 2 is provided with a lining 4 of a smooth material, the lining 4 being attached to peripheral body 2 at the position of insertion end 3, for instance by a stitched connection or in that the lining forms an integral part of peripheral body 2 and is folded back along a peripheral edge 5. The remaining part of lining 4 can be moved freely relative to peripheral body 2 from an inward folded position as shown in FIG. 1, in which lining 4 is located in peripheral body 2, to an outward folded position as shown in FIG. 2A in which lining 4 is located outside peripheral body 2. Peripheral body 2 is provided at an outer end with a pull member 6, for instance in the form of a strip of smooth material. Pull member 6 is connected by for instance a stitched connection to peripheral body 2. According to the invention peripheral body 2 also comprises tensioning means in the form of at least one elastic band 7 with which the aid 1 can be secured at least temporarily round a leg or foot 20. In the exemplary embodiments shown in the figures the elastic band 7 is received in a sheath or tunnel 8 of smooth material so that it can move therein. Sheath 8 for elastic band 7 forms an integral part of peripheral body 2 and is obtained by folding peripheral body 2 over onto itself at the position where elastic band 7 is arranged and stitching the edges thus brought together to each other. The elastic band 7 may comprise pieces of fabric material 70 that are received in the sheath 8 and that run slightly transversely of the elastic band 7. The pieces of material 70 provide friction between the elastic band 7 and the inner surface of the sheet 8.

Because elastic band(s) 7 is (are) substantially enclosed by smooth material, and preferably the same smooth material from which peripheral body 2 and/or lining 4 are manufactured, elastic band 7 causes no inconvenience when aid 1 is being pulled on.

Figure 3:
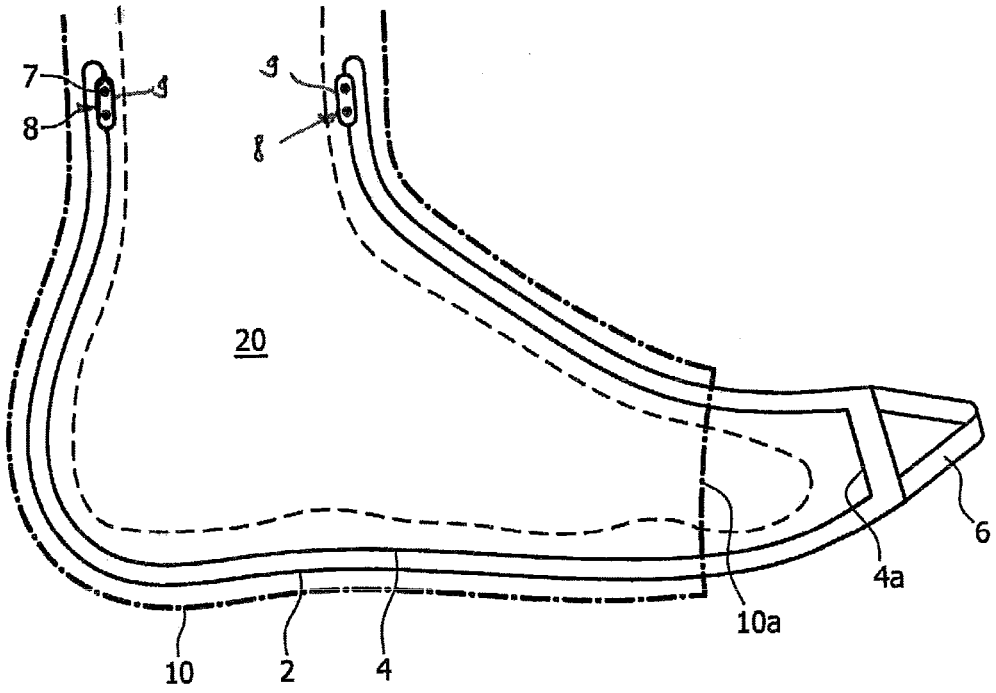
FIG. 3 is a schematic side view of an aid according to the invention arranged on a foot during pulling on of an elastic stocking.

When putting on a therapeutic stocking 10 the user places his/her foot 20 into aid 1 via insertion end 3, with lining 4 in inward folded position, as shown in FIG. 3. The toe of foot 20 is here generally inserted so far into aid 1 that the toe reaches outer end 4*a* of lining 4, and peripheral body 2 thus covers foot 20 (or the leg). An elastic stocking 10 with open toe part 10*a* is then slid over the aid 1 arranged round foot 20 or leg, wherein only little force need be exerted because of the easy sliding of elastic stocking 10 over the smooth material of peripheral body 2. Once the therapeutic elastic stocking 10 has been pulled on, aid 1 can be easily removed by pulling on peripheral body 2, or the pull member 6 attached thereto, at the position of the toe part. Lining 4 is here as it were peeled off over itself until it reaches the outward folded position (see for instance FIG. 2A) and aid 1 is fully pulled away from under elastic stocking 10. Hardly any frictional contact occurs here between the leg and the aid. Because the outer surface of sheath 8 is smooth (and elastic band 7 does not therefore come into contact with a body part and/or peripheral body 2 and/or lining 4), elastic stocking 10 slides easily over aid 1. Nor does elastic band 7 cause any inconvenience when the aid is being pulled off.

Figure 4A:
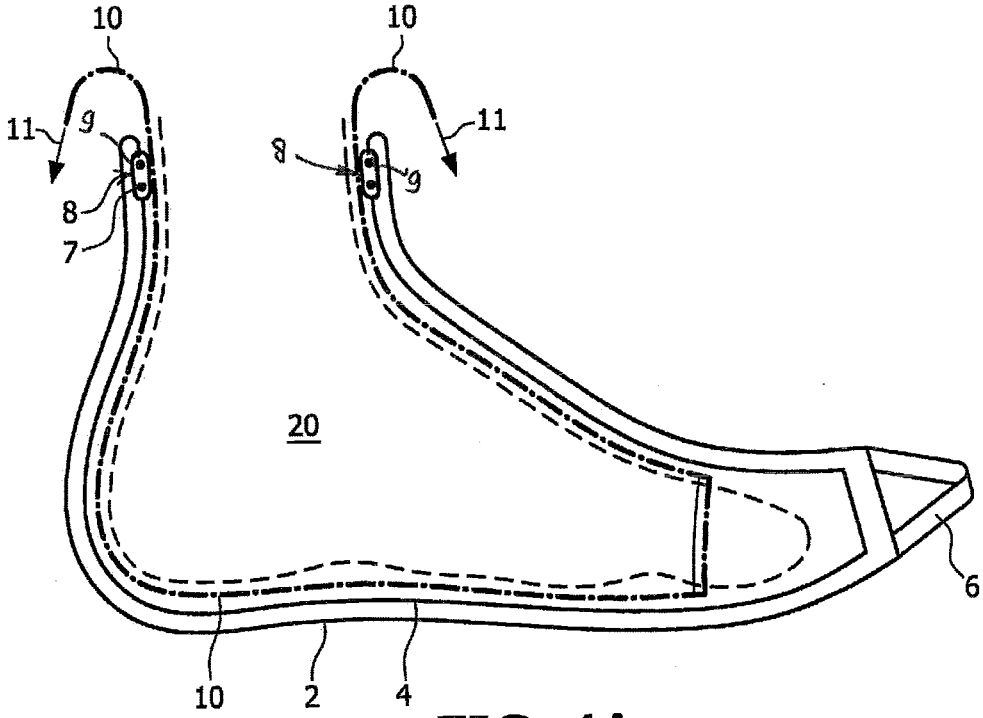
FIG. 4A is a schematic side view of an aid according to the invention arranged on a foot at a first stage during the removal of an elastic stocking.
Figure 4B:
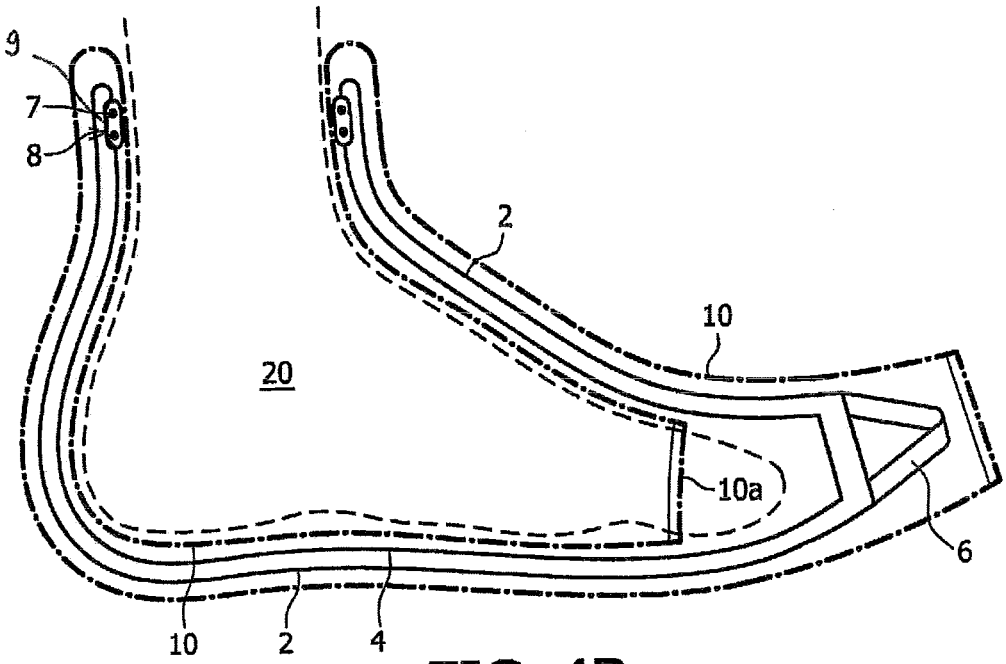
FIG. 4B is a schematic side view of an aid according to the invention arranged on a foot at a second stage during the removal of an elastic stocking.

In order to pull off an elastic stocking 10 (FIG. 4A) the user places his/her foot 20 via insertion end 3 into aid 1, with lining 4 in inward folded position, until the toe reaches outer end 4*a* of lining 4 and peripheral body 2 covers foot 20 or the leg. Elastic bands 7 are then tightened or close under their own tensioning force round the leg, the lower leg or the ankle of foot 20, whereby the aid is temporarily secured. The upper edges of elastic stocking 10 are then grasped and folded back in the direction 11 of foot 20 so that the folded part of elastic stocking 10 makes contact with peripheral surface 2. By now further unrolling the elastic stocking 10 by hand in the direction 11 of foot 20 (see FIG. 4B), peripheral body 2 will slide over lining 4. Although peripheral surface 2 and lining 4 are held against each other under the pressure of elastic stocking 10, the sliding will take place practically without friction, among other reasons because of the properties of the smooth material from which the aid is made. Lining 4, which is in contact with elastic stocking 10 or the leg, which contact could in principle cause quite a high friction force, remains substantially stationary during the pulling off. Elastic band or bands 7 ensure among other things that aid 1 and elastic stocking 10 do not slide prematurely from foot 20 during unrolling of elastic stocking 10. Owing to the elasticity of elastic bands 7 and because bands 7 are received in a sheath 8 of smooth material, the clamping action of elastic band 7 will, during further combined unrolling of stocking 10 and aid 1 in the direction 11 of foot 20, be automatically released by stretching of elastic bands 7. Once elastic stocking 10 has thus been removed from the leg, aid 1 is in inside-out position (with lining 4 in the outward folded position) in the pulled off elastic stocking 10. The aid can be easily removed herefrom.

Figure 5:
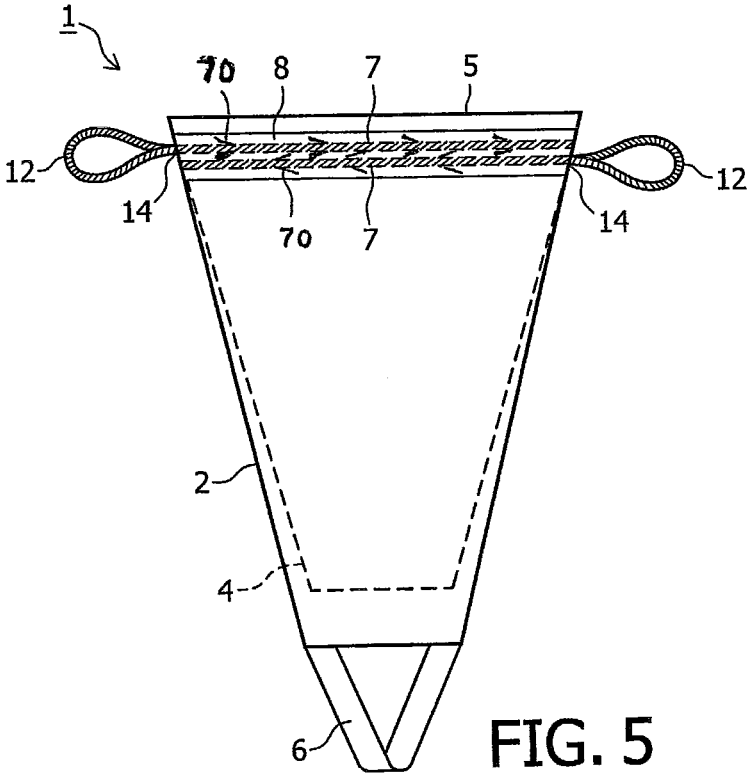
FIG. 5 is a schematic side view of yet another embodiment of the aid according to the invention; and finally

Referring to FIG. 5, an embodiment is shown wherein aid 1 is provided with two elastic bands 7 which are received in a sheath or tunnel 8 and which can be tightened by means of pull loops 12 accessible to the user. Sheath 8 comprises for this purpose two openings 14 through which protrude the pull loops 12 connected to elastic bands 7 or integrated therewith. Each elastic band lies substantially loosely in the sheath, in other words is freely movable therein. It is also possible to connect an elastic band at least at one location to sheath 8, for instance with a stitched connection, so that the sheath (and therefore also peripheral body 2) is co-displaced when elastic bands 7 are tightened. An embodiment with loosely fitting elastic band simplifies arranging of the aid. The tensioning force can moreover be adjusted by the user him/herself, subject to for instance the periphery of the leg or the ankle.

Figure 2B:
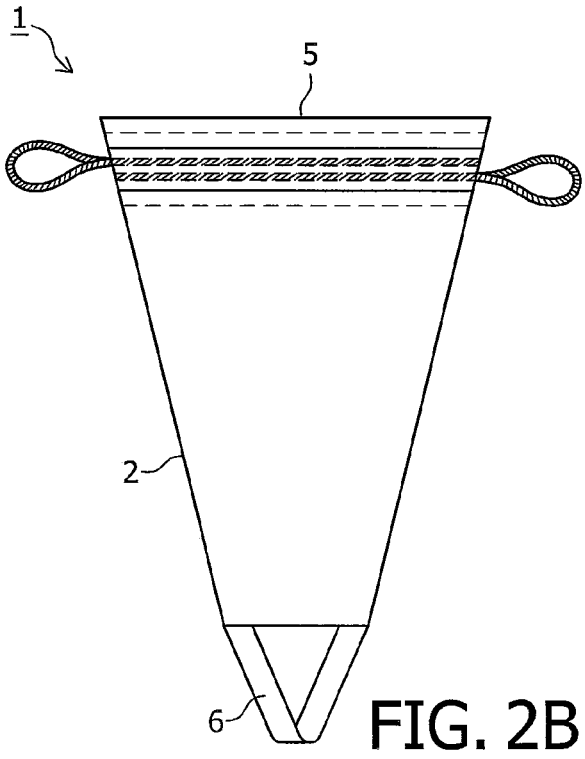
FIG. 2B is a schematic side view of the embodiment shown in FIG. 2A with the lining in the inward folded position.

Referring to FIGS. 2A and 2B, an embodiment of aid 1 is shown wherein sheath 8 is provided on the inner side thereof with a rough surface in the form of strips of cloth 9 with a coarse textile structure and/or with a cloth with a rough cover layer. Sheath 8 is hereby rough on the inner side, whereby it can transmit a friction force to elastic bands 7.

Figure 6:
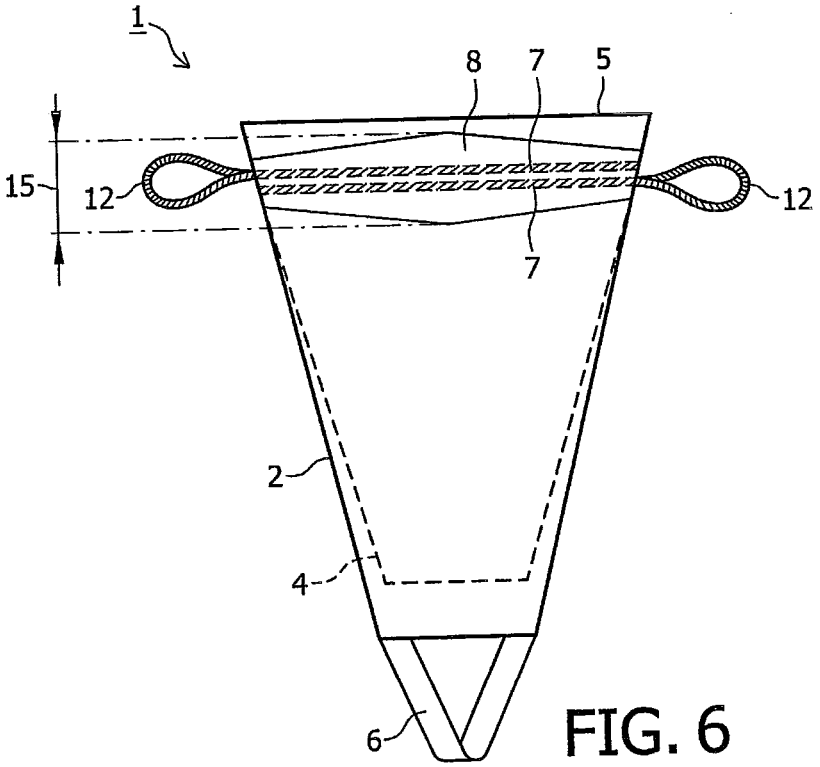
FIG. 6 is a schematic side view of yet another embodiment of the aid according to the invention.

Finally, FIG. 6 shows an exemplary embodiment wherein aid 1 comprises a sheath 8 which varies in width from a relatively narrow width at the position of pull loops 12 to a larger width 15 in the middle. This creates extra space in peripheral body 2 at the position of width 15, whereby it can be drawn together to greater extent when elastic bands 7 are tightened. This provides for a better fixation of aid 1 around a foot, leg or ankle provided with an elastic stocking.

The invention is not limited to the above described exemplary embodiments. It will be apparent that within the scope of the invention different modifications can be made which will be self-evident to the skilled person.

The invention claimed is:

1. An aid adapted for pulling elastic stockings on and off a leg, the aid comprising a flexible, tube-like peripheral body of a smooth material providing a substantially smooth outer surface of the aid, the peripheral body is provided with a lining of a smooth material, said lining being attached to the peripheral body at the position of a peripheral body's insertion end for a foot, such that said lining can, apart from said attachment, be moved freely relative to the peripheral body from an inward folded position, in which the lining is situated within the peripheral body and in which position a foot can be inserted in said body, to an outward folded position in which the lining is outside the peripheral body, wherein said peripheral body further comprises tensioning means configured to secure the aid at least temporarily around a leg with the lining in the inward folded position, and wherein the smoothness of the smooth material is such that when removing the aid from a leg provided with an elastic stocking, a coefficient of friction between the peripheral body and the lining is lower than a coefficient of friction between the elastic stocking and the lining, causing the peripheral body to slide over the lining when the peripheral body and the lining are held against each other under a pressure.

2. The aid of claim 1, wherein the tensioning means are received in a sheath of smooth material and can move therein.

3. The aid of claim 2, wherein the sheath forms an integral part of the peripheral body.

4. The aid of claim 2, wherein the sheath is provided on the inner side thereof with a rough surface wherein the roughness is such that a friction force is transmitted to the tensioning means when said tensioning means is tightened.

5. The aid of claim 2, wherein the sheath varies in width.

6. The aid of claim 1, wherein the tensioning means comprise an elastic band with a smaller circumference than that of the peripheral body.

7. The aid of claim 1, wherein the tensioning means comprise an elastic band which can be tightened by means of pull loops accessible to the user.

8. The aid of claim 7, wherein the aid also comprises fixing means for the purpose of providing resistance to springing back of the tensioning means in the tensioned state.

9. The aid of claim 8, wherein the fixing means comprise pieces of fabric which are received in the sheath and which run substantially transversely of the tensioning means and are provided with an opening through which the tensioning means pass.

10. The aid of claim 1, wherein the smooth material comprises a material structure coated with a polyolefin.

11. The aid of claim 1, wherein the peripheral body and the lining are manufactured from the same smooth material.

12. The aid of claim 4, wherein the rough surface is obtained by providing the inner side of the sheath with a cloth with a coarse textile structure.

13. The aid of claim 4, wherein the rough surface is obtained by constructing the inner side of the sheath from a cloth provided with a rough cover layer, comprising a rubber.

14. The aid of claim 1, further comprising a pull member attached to the peripheral body.

15. The aid of claim 1, wherein the smooth material comprises a material structure coated with polytetrafluoroethylene.

16. The aid of claim 1, wherein the smooth material comprises a textile structure of glass fibres, carbon fibres, organic fibres, polyethylene fibres, polyamide fibres or polyester fibres, or combinations thereof.

17. The aid of claim 16, wherein the textile structure is coated with a polyolefin, polytetrafluoroethylene or a combination thereof.

18. The aid of claim 1, wherein the smooth material comprises a textile structure having a weight per unit area of between 10 and 200 $g/m^2$.

* * * * *